US011441857B2

(12) United States Patent
Lendi

(10) Patent No.: US 11,441,857 B2
(45) Date of Patent: Sep. 13, 2022

(54) CROSS-JET NOZZLE AND LANCE DEVICE

(71) Applicant: Enz Technik AG, Giswil (CH)

(72) Inventor: Christoph Lendi, Giswil (CH)

(73) Assignee: Enz Technik AG, Giswil (CH)

( * ) Notice: Subject to any disclaimer, the term of this patent is extended or adjusted under 35 U.S.C. 154(b) by 753 days.

(21) Appl. No.: 16/382,368

(22) Filed: Apr. 12, 2019

(65) Prior Publication Data

US 2019/0316857 A1 Oct. 17, 2019

(30) Foreign Application Priority Data

Apr. 13, 2018 (CH) ..... 00471/18

(51) Int. Cl.

| | |
|---|---|
| ***F28G 3/16*** | (2006.01) |
| ***B05B 13/06*** | (2006.01) |
| ***B08B 9/032*** | (2006.01) |
| ***B08B 9/043*** | (2006.01) |
| ***B05B 3/04*** | (2006.01) |
| ***B08B 9/04*** | (2006.01) |
| ***B05B 3/00*** | (2006.01) |

(52) U.S. Cl.

CPC ..... *F28G 3/163* (2013.01); *B05B 3/00* (2013.01); *B05B 3/0427* (2013.01); *B05B 13/0636* (2013.01); *B08B 9/0321* (2013.01); *B08B 9/0323* (2013.01); *B08B 9/04* (2013.01); *B08B 9/0433* (2013.01)

(58) Field of Classification Search

CPC ..... B05B 3/00; B05B 3/0427; B05B 3/0486; B05B 3/06; B05B 13/0636; B08B 9/0321; B08B 9/0323; B08B 9/04; B08B 9/0433; F28G 3/163

See application file for complete search history.

(56) References Cited

U.S. PATENT DOCUMENTS

| | | | | |
|---|---|---|---|---|
| 2,318,769 A * | 5/1943 | Freeman | B23P 15/16 | 29/890.143 |
| 3,744,723 A * | 7/1973 | Davis | B05B 1/14 | 239/560 |
| 3,987,963 A * | 10/1976 | Pacht | B05B 13/0636 | 134/167 C |
| 4,715,538 A * | 12/1987 | Lingnau | B26F 3/004 | 134/167 C |
| 7,007,865 B2 * | 3/2006 | Dodd | B05B 1/1672 | 239/249 |

(Continued)

*Primary Examiner* — Ryan A Reis
(74) *Attorney, Agent, or Firm* — Paul D. Bianco; Katharine Davis Wong; Fleit Intellectual Property Law

(57) ABSTRACT

A cross-jet nozzle includes a rotor body, in which several channels are recessed or formed running from a nozzle tip in the direction of a stator body, in which at least two front jet nozzles are positioned in the rotor body through at least two front jet channels and oriented so that front jets of a pressurized medium emerging from the front jet channels intersect outside of the rotor body and the rotor body can be mounted to rotate around its longitudinal axis on the stator body, which can be connected to a high-pressure line connection, is introduced safely parallel into tubes by a drive unit of a lance device. The nozzle tip is provided with an outer surface so that the surface is configured convexly arched, dome-like and free of edges and the nozzle tip is formed mirror-symmetric with the longitudinal axis in profile.

9 Claims, 2 Drawing Sheets

(56) References Cited

U.S. PATENT DOCUMENTS

| | | | | |
|---|---|---|---|---|
| 8,298,349 | B2 * | 10/2012 | Wojciechowski, III | B05B 13/0636 134/167 C |
| 9,399,230 | B2 * | 7/2016 | Wojciechowski, III | B05B 13/0636 |
| 2015/0306437 | A1 * | 10/2015 | Hunter | B05B 3/1021 239/264 |

* cited by examiner

CROSS-JET NOZZLE AND LANCE DEVICE

TECHNICAL FIELD

The present invention describes a cross-jet nozzle, comprising a rotor body in which several channels are recessed or formed, running from a nozzle tip in the direction of a stator body, at least two front jet nozzles being positioned in the rotor body through at least two front jet channels and oriented so that front jets of a pressurized medium emerging from the front jet channels intersect outside of the rotor body and the rotor body can be mounted to rotate around its longitudinal axis on the stator body, which can be connected to a high-pressure line connection, as well as a lance device for the cleaning of tube bundles, comprising at least one lance, on which a number of cross-jet nozzles are operably fastened.

BACKGROUND

Robot-supported cleaning is on the advance in the technical field of high-pressure pipe cleaning nozzles, in which pipes and shafts are cleaned by means of a pressurized medium, preferably water, with multipart nozzles rotating around a longitudinal axis. Individual high-pressure tube cleaning nozzles are no longer introduced by hand into various tubes, for example, of a heat exchanger or evaporator, but instead this is accomplished by means of robots and lance devices. Several cross-jet nozzles are introduced to the corresponding accesses simultaneously and parallel during industrial cleaning of heat exchangers. Cross-jet nozzles include a rotor body that discharges two jets of a pressurized medium that intersect outside of the rotor body in the advance direction of the cross jet nozzle. This crossed jet directed forward in the advance direction is capable of cutting material out of a clogged tube, like a milling cutter. In addition to the crossed jet, radial nozzles are generally also arranged in the rotor body, from which additional jets of a pressurized medium can escape for actual rotation of a rotor body and/or for cleaning of the tube walls. The operating pressures now lie at about 1000 bar but are also significantly raised to 3000 bar.

Such cross-jet nozzles are used intensively for the simultaneous cleaning of tube bundles, in which the individual tubes of the tube bundle are several meters deep. Controlled lance devices are used for this purpose, which have several lances each having a cross-jet nozzle. The cross-jet nozzles mounted on the lances are introduced into the parallel channels rotating at a few hundred revolutions per minute and then pulled out again by remote control. Several lances are operated linearly parallel to each other by means of a drive unit, whereas the cross-jet nozzles during operation rotate around their longitudinal axes under a pressure load of up to 3000 bar. Because of the limited space conditions, the desired spacing of adjacent cross-jet nozzles or lances having cross-jet nozzles is very limited.

Owing to the high pressures of the cleaning fluids, high recoil forces result on each cross-jet nozzle and therefore on each lance and on the drive unit. Through additional rotational forces, tracking and adjustment of each individual cross-jet nozzle becomes increasingly problematic and jamming of the cross-jet nozzles and the lances often occurs in the channels being cleaned. Controlled alignment during advancement of the cross-jet nozzles is often no longer attainable. In addition to a deteriorated cleaning effect, safety problems also occur, which must absolutely be solved.

Thus far, this has been remedied by equipping the lance devices and their drive units with costly positioning frames, guide devices and spring-loaded arrangement of the lances or cross-jet nozzles. These solutions are technically very demanding and come with increased costs, and often do not lead to the objective in practice. The necessary safety of controlled linear introduction of individual cross-jet nozzles is not guaranteed.

SUMMARY OF THE INVENTION

One aspect of the present invention relates to addressing the problem of reliable parallel simultaneous introduction of several cross-jet nozzles by means of a drive unit of a lance device so that the necessary safety is achieved during operation.

Because such cross-jet nozzles are used in the appropriate lances of lance devices, such a lance device having several such cross-jet nozzles is another aspect of the present invention.

BRIEF DESCRIPTION OF THE DRAWINGS

A preferred practical embodiment of the invention is described below in conjunction with the appended drawings in which:

FIG. 1*a* shows a perspective view of a cross-jet nozzle, whereas

DESCRIPTION

Figure 1A:
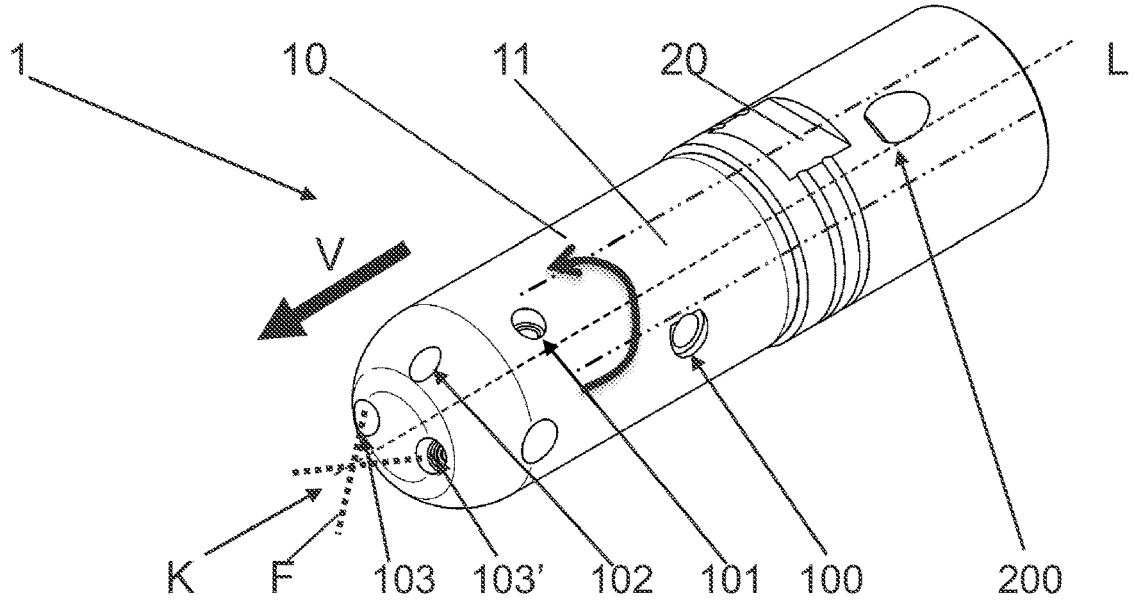

A cross-jet nozzle 1 is described, comprising a rotor body 10 having a number of channels and nozzles. The cross-jet nozzle 1 here is designed in two parts, the rotor body 10 being mounted to rotate on a stator body 20. Either the rotor body 10 is positioned on the lance 2 of a controllable lance device 3 for automatic cleaning of tube bundles or the stator part 20 can be designed as part of the lance 2 of the lance device 3. The rotor body 10 is mounted to rotate around a longitudinal axis L with the nozzles having different functions.

Channels that lead to at least one cleaning nozzle 100, a rotating nozzle 101 and a decelerating jet nozzle 102 emerge from a feed channel 11 as indicated in FIG. 1 with dashed lines, which crosses the rotor body 10 in the direction of the longitudinal axis L. Two front jet nozzles 103, 103' in the rotor body 10 serve as the namesake of the cross-jet nozzle 1. Whereas the cleaning nozzle 100 and the rotating nozzle 101 and at least one advance nozzle 200 are aligned in the stator body 20 radially or radially opposite the advance direction V, the front jet nozzles 103, 103' and the decelerating jet nozzle 102 point at least partially in the advance direction V. Accordingly, the pressurized medium flows from the feed channel 11 via the nozzles in different directions and at different speeds from the rotor body 10. The nozzle geometry is generally adapted to the desired jet forms using movable nozzle inserts, which, however, will not be further taken up here.

The at least two front jet nozzles 103, 103' are arranged in the area of a nozzle tip D so that front jets F of the pressurized medium result, which overlap across outside the rotor body 10 so that a crossed jet K is formed from at least two front jets F.

Figure 1B:
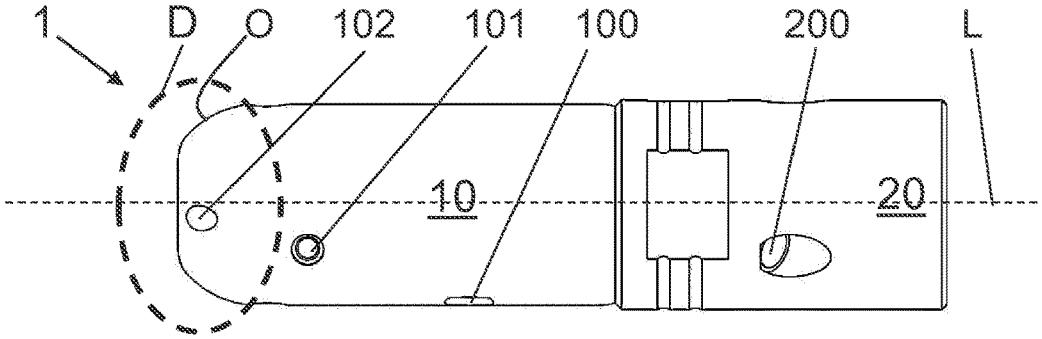
FIG. 1*b* shows a side view of the cross-jet nozzle.
Figure 2:
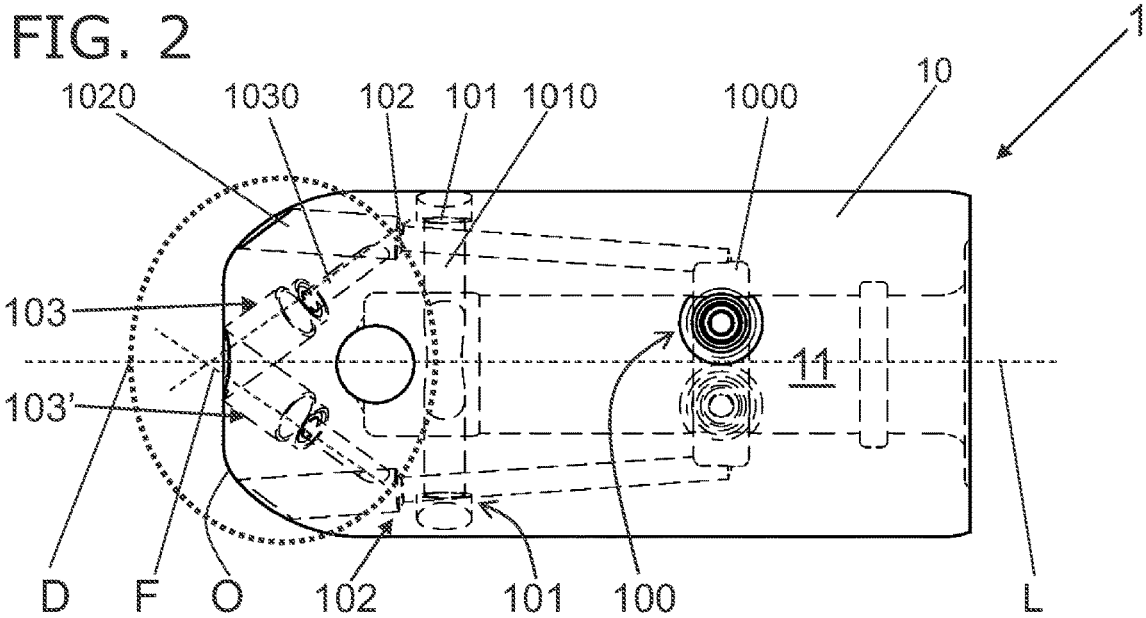
FIG. 2 shows a longitudinal section through the rotor body of the cross-jet nozzle.
Figure 3:
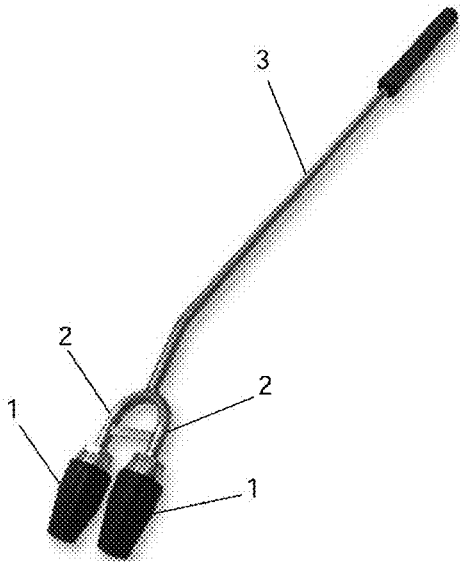
FIG. 3 shows a perspective view of an exemplary controllable lance device having cross-jet nozzles operably fastened to lances.

In the side view according to FIG. 1*b*, the area of the nozzle tip D of the rotor body 1 of particular interest is marked with a dashed line. The nozzle tip D is arranged on the end of the rotor body 10 viewed in the advance direction V and, in comparison with nozzles of the prior art, is provided with a convexly arched surface O. The surface O is configured dome-like and free of edges here. Steps and edges are avoided so that fluids can flow from the nozzle tip D to the tubes being cleaned without increasing resistance. The nozzle tip D has no edges, protrusions or hooks on which the nozzle tip D of the cross-jet nozzle 1 can jam against the interior tube wall or at transitions. The profile of the nozzle tip D in the advance direction V is configured with a surface O shaped mirror-symmetric with the longitudinal axis L. The surface O can be configured dome-like, as a hemispherical surface or generally as a semi-ellipsoid surface. The nozzle tip D is therefore designed rotationally symmetric.

Because of special shaping of the nozzle tip D and the surface O, an additional working step is necessary to form the nozzle tip D because only deburred, arched surfaces O free of edges formed in this way permit mechanically conducted parallel and simultaneous introduction of many cross-jet nozzles 1 without interfering and jamming and therefore reliable cleaning of tube bundles.

After production of the rotor body 10 with an arched surface O in the area of the nozzle tip D, cleaning nozzle channels 1000, rotating jet channels 1010, decelerating jet nozzle channels 1020 and front jet channels 1030, 1030' branching off directly or indirectly from the centrally arranged feed channel 11 are introduced to the rotor body 10. The alignment of the channels 1000, 1010, 1020 and 1030, 1030' must be oriented according to their eventual function. After insertion of the nozzle 6 the rotor body 10 is acted upon by means of a high-pressure connection using a pressurized medium having pressures of up to 3000 bar. Even during rotation of the rotor body 10 at several hundred revolutions per minute, the cross-jet nozzle 1 can be simply and reliably guided through tubes in the advance direction V. The inside diameter of the tubes then need only be slightly greater than the outside diameter of the rotor body 10 in the area adjacent to the nozzle tip D.

The rotor body 10 is designed in one piece and formed from a hardened corrosion-resistant material. The front jet channels 1030 angled relative to each other are introduced to the rotor body 10 after shaping of the nozzle tip D with a dome-like profile free of edges. The decelerating jet nozzle channels 1020 are also preferably introduced after shaping of the nozzle tip D with an arched surface O, in which case all channels 1030, 1020 lead to the feed channel 11 so that cleaning fluid can be guided to emerge from the corresponding nozzles from a high-pressure line connection via the stator body 20, crossing the rotor body 10 through various channels 1030, 1020.

LIST OF REFERENCE NUMBERS

1 Cross-jet nozzle
10 Rotor body
100 Cleaning nozzle
  1000 Cleaning nozzle channel
101 Rotating nozzle
  1010 Rotating jet channel
102 Decelerating jet nozzle
  1020 Decelerating jet nozzle channel
103, 103' Front jet nozzle
  1030 Front jet channel (overlapping)
11 Feed channel
20 Stator body
  200 Recoil nozzle
F Front jet
K Crossed jet
D Nozzle tip
O Surface (arched, semi-ellipsoid or hemispherical)
L Longitudinal axis
2 lance
3 controllable lance device

The invention claimed is:

1. A cross-jet nozzle comprising:

a stator body connectable to a high-pressure line connection;

a rotor body mounted on the stator body and configured to rotate on the stator body around a longitudinal axis of the rotor body, the rotor body having a nozzle tip and an outer surface free of edges along a length thereof from the nozzle tip to the stator body;

a plurality of channels formed in the rotor body, each channel of the plurality of channels running from the nozzle tip in a direction of the stator body;

wherein, at least two channels of the plurality of channels are front jet channels having front jet channel openings in the nozzle tip configured such that front jets of a pressurized medium emerging from the front jet channels intersect outside of the rotor body; and wherein, an outer surface of the nozzle tip is convexly arched and free of edges.

2. The cross-jet nozzle according to claim 1, wherein the outer surface of the rotor body is a cylindrical outer surface free of edges along an entire length thereof from the nozzle tip to the stator body.

3. The cross-jet nozzle according to claim 1, wherein the nozzle tip is rotationally symmetric.

4. The cross-jet nozzle according to claim 1, wherein a side profile of the nozzle tip has a semi-ellipsoid shape or a hemisphere shape.

5. The cross-jet nozzle according to claim 1, wherein the outer surface of the nozzle tip has a semi-ellipsoid shape or a hemispherical shape.

6. A lance device for cleaning of tube bundles comprising:

a plurality of lances, each lance of the plurality of lances operably fastenable to a cross-j et nozzle; and a plurality of cross-jet nozzles, each cross-jet nozzle of the plurality of cross-jet nozzles operably fastened to a lance of the plurality of lances;

wherein at least one cross-jet nozzle of the plurality of cross-jet nozzles includes:

a stator body connectable to a high-pressure line connection;

a rotor body mounted on the stator body and configured to rotate on the stator body around a longitudinal axis of the rotor body, the rotor body having a nozzle tip and an outer surface free of edges along a length thereof from the nozzle tip to the stator body;

a plurality of channels formed in the rotor body, each channel of the plurality of channels running from the nozzle tip in a direction of the stator body;

wherein, at least two channels of the plurality of channels are front jet channels having front jet channel openings in the nozzle tip configured such that front jets of a pressurized medium emerging from the front jet channels intersect outside of the rotor body; and wherein, an outer surface of the nozzle tip is convexly arched and free of edges.

7. The lance device according to claim 6, wherein lances of the plurality of lances are parallelly arranged and configured for automatic parallel introduction into and retraction from tubes of the tube bundles by a drive unit of the lance device.

8. A lance device having the cross-jet nozzle according to claim 2.

9. The lance device according to claim 8, wherein a plurality of lances are arranged parallel to each other and configured for automatic parallel introduction into and retraction from tubes of tube bundles by a drive unit of the lance device.

* * * * *